United States Patent [19]

Novak

[11] Patent Number: 4,967,422

[45] Date of Patent: Nov. 6, 1990

[54] CLOSET FLANGE PROTECTOR

[76] Inventor: Russell R. Novak, 7849 Forsythe St., Sunland, Calif. 91040

[21] Appl. No.: 406,025

[22] Filed: Sep. 11, 1989

[51] Int. Cl.[5] ..... E03D 11/00

[52] U.S. Cl. ..... 4/252 R; 4/295; 4/661; 52/244; 138/96 R; 138/96 T; 138/89; 285/56

[58] Field of Search ..... 4/252 R, 295, 661, DIG. 9; 285/238, 342, 349, 192, 56, 58, 59-60; 138/89, 96 R, 96 T; 52/244

[56] References Cited

U.S. PATENT DOCUMENTS

| | | | |
|---|---|---|---|
| 490,536 | 1/1893 | Boston | 52/244 |
| 1,999,277 | 4/1935 | Boosey | 285/42 |
| 2,454,356 | 11/1948 | Thornhill | 285/342 |
| 2,679,155 | 5/1954 | Zinn | 285/56 X |
| 3,048,911 | 8/1962 | Almon | 138/89 X |
| 3,800,486 | 4/1974 | Harvey | 285/56 X |
| 3,823,744 | 7/1974 | Logsdon | 138/89 X |
| 3,942,141 | 3/1976 | Kaffenberger | 285/349 |
| 4,052,759 | 10/1977 | Hill | 4/252 R |
| 4,150,848 | 4/1979 | Dyrup | 285/238 |
| 4,212,486 | 7/1980 | Logsdon | 4/252 R |
| 4,372,587 | 2/1983 | Roche | 285/238 |
| 4,433,860 | 2/1984 | Lindquist | 285/192 |
| 4,694,863 | 9/1987 | Klopp | 138/96 R |

*Primary Examiner*—Henry K. Artis
*Attorney, Agent, or Firm*—Leon Gilden

[57] ABSTRACT

A closet flange protector is set forth to protect and overlie a water closet flange and test plugs during a construction proceeding. The protector includes an inverted cup-shaped member including an upper disk portion provided with spaced diametrically opposed wells. A downwardly depending skirt depends downwardly from the disk and associated wells terminating in a continuous conical skirt. The conical skirt and wells include aligned through-extending apertures for receiving diametrically opposed threaded bolts. The bolts include threaded fasteners received within the wells to secure the well to a floor structure and overlie an associated water closet flange.

6 Claims, 1 Drawing Sheet

CLOSET FLANGE PROTECTOR

BACKGROUND OF THE INVENTION

1. Field of the Invention

The field of invention relates to plumbing devices, and more particularly pertains to a new and improved closet flange protector wherein the same overlies a plumbing conduit construction to protect same during a construction occurring about the fixture.

2. Description of the Prior Art

The use of various plumbing devices in the construction trade is well known in the prior art. During a construction proceeding, however, such plumbing fixtures are frequently and inadvertently damaged or covered by various construction materials, such as concrete, plaster, etc. Plumbing fixtures of the prior art include U.S. Pat. No. 2,454,356 to Thornhill setting forth a ring sealed joint wherein the same illustrates the use of a plurality of conduits secured relative to one another by an intermediate circumferential seal.

U.S. Pat. No. 3,942,141 to Kaffenberger sets forth a flange organization to enable subsequent securement of the tube to a further plumbing or electrical member.

U.S. Pat. No. 4,372,587 to Roche sets forth a flange arrangement for securing independent pipes relative to one another utilizing a plurality of aligned bolts spaced orthogonally relative to the aligned axis of the tubes.

U.S. Pat. No. 4,433,860 to Lindquist sets forth a tubular fitting provided with an annular flange and a plurality of spaced clamping members spaced from the flange to receive a support structure therebetween.

U.S. Pat. No. 4,150,848 to Dyrup sets forth a hose coupling for use particularly with non-metallic hose.

The various examples of the prior art exemplify an ongoing need for a new and improved closet flange protector wherein the same addresses both the problems of effectiveness in construction and ease of use to an associated plumbing fixture, and in this respect, the present invention substantially fulfills this need.

SUMMARY OF THE INVENTION

In view of the foregoing disadvantages inherent in the known types of plumbing fixture protective devices now present in the prior art, the present invention provides a closet flange protector wherein the same is securable in a surrounding and overlying relationship to a plumbing fixture projecting through a structural support surface to protect the same prior to use. As such, the general purpose of the present invention, which will be described subsequently in greater detail, is to provide a new and improved closet flange protector which has all the advantages of the prior art plumbing protective devices and none of the disadvantages.

To attain this, the closet flange protector comprises an annular disk provided with diametrically opposed wells with through-extending apertures directed medially of the walls. A surrounding downwardly depending skirt is integrally secured to the disk adjacent the wells and terminates in an inwardly directed conical skirt. The conical skirt is provided with a plurality of apertures each aligned with an overlying aperture of an associated well. A plurality of bolts are directed through the conical skirt and the wells with securement nuts positioned within the wells to fasten the protector overlying a plumbing fixture.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new closet flange protector which has all the advantages of the prior art plumbing protective devices and none of the disadvantages.

It is another object of the present invention to provide a new closet flange protector which may be easily and efficiently manufactured and marketed.

It is a further object of the present invention to provide a new closet flange protector which is of a durable and reliable construction.

An even further object of the present invention is to provide a new closet flange protector which is susceptible of a low cost of manufacture with regard to both materials and labor, and which accordingly is then susceptible of low prices of sale to the consuming public, thereby making such plumbing flange protectors economically available to the buying public.

Still yet another object of the present invention is to provide a new and improved closet flange protector which provides in the apparatuses and methods of the prior art some of the advantages thereof, while simultaneously overcoming some of the disadvantages normally associated therewith.

Still another object of the present invention is to provide a new and improved closet flange protector utilizing an inverted cup-shaped member readily and effectively securable overlying and in surrounding relationship to a plumbing fixture to protect the same during a construction procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated prerferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
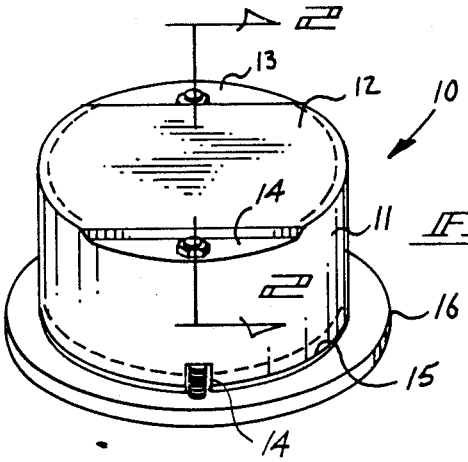
FIG. 1 is an isometric illustration of the instant invention.
Figure 2:
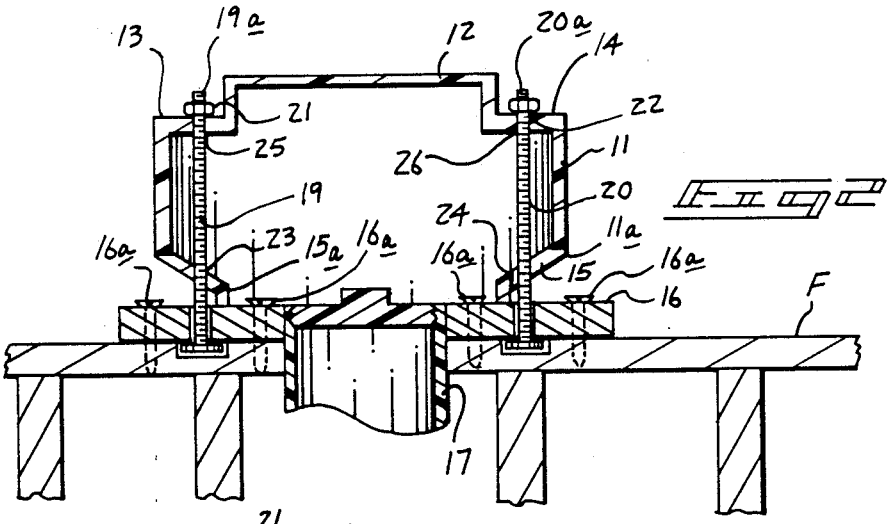
FIG. 2 is an orthographic view taken along the lines 2—2 of FIG. 1 in the direction indicated by the arrows.
Figure 3:
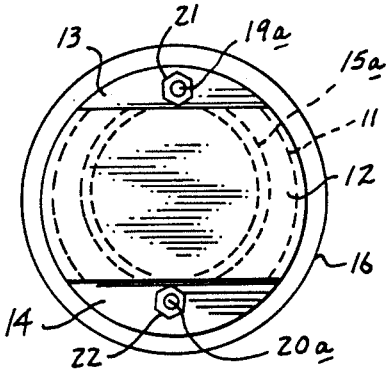
FIG. 3 is a top orthographic view of the instant invention.

With reference now to the drawings, and in particular to FIGS. 1 to 3 thereof, a new and improved closet flange protector embodying the principles and concepts of the present invention and generally designated by the reference numeral 10 will be described.

More specifically, it will be noted that the closet flange protector 10 essentially comprises a downwardly depending cylindrical skirt 11 continuously formed to and integral to an overlying solid top disc 12. The top disc 12 includes a plurality of spaced wells comprising a first well 13 and a second well 14 defined by cylindrical relief portions recessed within diametrically opposed upper end portions of the top disc 12 and skirt portions 11 formed as recessed prismoidal depressions formed downwardly extending from an upper surface of the top disk 12 positioned adjacent the cylindrical skirt 11 wherein the axis of each well is generally parallel to an axis defined by the cylindrical skirt 11. The cylindrical skirt 11 terminates at a lowermost edge 11*a* and is directed into an integral inwardly depending conical skirt 15 directed interiorly of the cylindrical skirt 11. The conical skirt 15 includes a forwardmost conical end generally aligned with an interior wall of each of a respective well 13 and 14 most adjacent the axis "A" of the cylindrical skirt 11. The plumbing fixture 10, and more specifically the forward terminal end 15*a* of the conical skirt 15, overlies a floor stratum 16 and in surrounding relationship to a projecting plumbing conduit 17 provided with a plug 18 directed into a threaded upper end of the plumbing conduit 17 through a floor portion "F". The axis "A" is aligned with an axis defined by the plumbing conduit 17 to center the flange protector 10 over the conduit 17. The floor stratum 16 is secured to the floor "F" by a series of non-corrosive fasteners 16*a*, such as brass or stainless steel wood screws.

Securing the flange protector 10 over the conduit 17 is a respective first and second bolt 19 and 20 that are directed through the stratum 16 and through aligned apertures formed within the conical skirt 15 and a respective overlying well 13 and 14 respectively. A respective first and second securement nut 21 and 22 are received within the respective well 13 and 14 and secures the respective first and second bolt 19 and 20 to fixedly secure the protector 10 to the stratum 16. The conical skirt 15 includes a respective first and second conical skirt aperture 23 and 24 that is aligned with a respective first and second well aperture 25 and 26 formed within each respective well 13 and 14.

The inwardly tapering conical skirt 15 enables visual observation of the various fastening members 16*a*, 19, and 20. Further, the skirt enables visual inspection to ensure that the bolts utilized are comprised essentially of brass, as is required by typical construction codes in the industry.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifcations and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A closet flange protector device for use in combination with a terminal end of a conduit directed through a floor, said device comprising, a base stratum overlying the floor, a cup means for aligned overlying securement relative to said conduit, and including a plurality of spaced connector members each directed through the stratum and through the cup means to fixedly secure the cup means to the stratum, and wherein the cup means includes a top circular solid disk member including a downwardly directed cylindrical skirt, said disk member including a plurality of spaced diametrically opposed wells directed downwardly relative to the top surface of the disk member and wherein the wells are positioned adjacent the skirt, and wherein each well receives a connector means therethrough.

2. A closet flange protector device as set forth in claim 1 wherein the cylindrical skirt includes a lower terminal end with an integral inwardly depending conical skirt directed interiorly of the cylindrical skirt, and a forward terminal end of the conical skirt aligned with an inner wall of each well wherein each inner wall is spaced from the cylindrical skirt.

3. A closet flange protector device as set forth in claim 2 wherein each well includes a well aperture extending therethrough, and the conical skirt includes a plurality of diametrically opposed skirt apertures therethrough, and wherein each respective well aperture is aligned with an underlying skirt aperture, the base stratum including stratum apertures, and each aligned skirt aperture, well aperture and stratum aperture receives a connector member therethrough, and further including fastening members to secure the base stratum to the floor.

4. A closet flange protector device as set forth in claim 3 wherein each connector member comprises a threaded bolt, and further including a securement nut positioned within each well and threadedly secured to an upper terminal end of each threaded bolt.

5. A closet flange protector device as set forth in claim 4 wherein the solid top disk is defined by an orthogonally oriented axis and the axis is aligned with a further axis defined by the conduit.

6. A closet flange protector device as set forth in claim 5 wherein each threaded bolt is formed of brass to resist corrosion.

* * * * *